US009023197B2

(12) United States Patent
Kift et al.

(10) Patent No.: US 9,023,197 B2
(45) Date of Patent: May 5, 2015

(54) METHODS FOR OBTAINING BITUMEN FROM BITUMINOUS MATERIALS

(75) Inventors: Julian Kift, Reno, NV (US); Cherish M. Hoffman, Reno, NV (US); Whip C. Thompson, Reno, NV (US)

(73) Assignee: Shell Oil Company, Houston, TX (US)

( * ) Notice: Subject to any disclaimer, the term of this patent is extended or adjusted under 35 U.S.C. 154(b) by 309 days.

(21) Appl. No.: 13/557,503

(22) Filed: Jul. 25, 2012

(65) Prior Publication Data

US 2013/0026076 A1 Jan. 31, 2013

Related U.S. Application Data

(60) Provisional application No. 61/511,906, filed on Jul. 26, 2011, provisional application No. 61/525,567, filed on Aug. 19, 2011.

(51) Int. Cl.

| | |
|---|---|
| ***C10G 1/04*** | (2006.01) |
| ***C10G 21/02*** | (2006.01) |
| ***C10G 21/06*** | (2006.01) |
| ***C10G 21/14*** | (2006.01) |
| ***C10G 21/28*** | (2006.01) |
| ***C10G 1/00*** | (2006.01) |

(52) U.S. Cl.
CPC ... *C10G 1/04* (2013.01); *C10G 1/00* (2013.01)

(58) Field of Classification Search
CPC ..... C10G 1/04; C10G 21/02; C10G 21/06; C10G 21/14; C10G 21/28
See application file for complete search history.

(56) References Cited

U.S. PATENT DOCUMENTS

| | | | | |
|---|---|---|---|---|
| 2,871,180 | A | | 1/1959 | Lowman et al. |
| 3,131,141 | A | | 4/1964 | West |
| 3,484,365 | A | | 12/1969 | Pitchford |
| 3,527,692 | A | | 9/1970 | Titus |
| 3,565,593 | A | | 2/1971 | Moore et al. |
| 3,565,594 | A | | 2/1971 | Moore |
| 3,779,902 | A | | 12/1973 | Mitchell et al. |
| 4,035,282 | A | | 7/1977 | Stuchberry et al. |
| 4,046,668 | A | | 9/1977 | Farcasiu et al. |
| 4,054,506 | A | | 10/1977 | Hart, Jr. et al. |
| 4,120,773 | A | | 10/1978 | Ridgway |
| 4,120,777 | A | | 10/1978 | Globus |
| 4,139,450 | A | | 2/1979 | Hanson et al. |
| 4,222,873 | A | | 9/1980 | Parsons |
| 4,224,138 | A | | 9/1980 | Kruyer |
| 4,250,016 | A | | 2/1981 | Estes et al. |
| 4,308,133 | A | | 12/1981 | Meyer |
| 4,347,118 | A | | 8/1982 | Funk et al. |
| 4,455,216 | A | * | 6/1984 | Angevine et al. ..... 208/390 |
| 4,490,259 | A | | 12/1984 | Coffing |
| 4,512,872 | A | | 4/1985 | Chung et al. |
| 4,589,980 | A | | 5/1986 | Keys |
| 4,592,826 | A | | 6/1986 | Ganguli |
| 4,596,651 | A | | 6/1986 | Wolff et al. |
| 4,612,113 | A | | 9/1986 | Kallioinen |
| 4,676,889 | A | | 6/1987 | Hsieh et al. |
| 4,678,561 | A | | 7/1987 | Keys |
| 4,678,562 | A | | 7/1987 | Keys |
| 4,702,487 | A | | 10/1987 | Stoian et al. |
| 4,722,782 | A | | 2/1988 | Graham et al. |
| 4,724,272 | A | | 2/1988 | Raniere et al. |
| 4,744,890 | A | | 5/1988 | Miller et al. |
| 4,846,964 | A | | 7/1989 | Scott et al. |
| 4,859,317 | A | | 8/1989 | Shelfantook et al. |
| 5,044,552 | A | | 9/1991 | Becker et al. |
| 5,084,160 | A | | 1/1992 | Stewart et al. |
| 5,143,598 | A | | 9/1992 | Graham et al. |
| 5,176,802 | A | | 1/1993 | Duyvesteyn et al. |
| 5,223,148 | A | | 6/1993 | Tipman et al. |
| 5,236,577 | A | | 8/1993 | Tipman et al. |
| 5,295,665 | A | | 3/1994 | Mackie |
| 5,389,274 | A | | 2/1995 | Fernandez |
| 5,443,158 | A | | 8/1995 | McKenny et al. |
| 5,485,883 | A | | 1/1996 | Rippetoe et al. |
| 5,520,799 | A | | 5/1996 | Brown et al. |
| 5,534,136 | A | | 7/1996 | Rosenbloom |
| 5,538,081 | A | | 7/1996 | Rippetoe et al. |
| 5,554,301 | A | | 9/1996 | Rippetoe et al. |
| 5,626,743 | A | | 5/1997 | Humphreys |
| 5,626,793 | A | | 5/1997 | Reiffenrath et al. |
| 5,670,056 | A | | 9/1997 | Yoon et al. |

(Continued)

FOREIGN PATENT DOCUMENTS

| | | |
|---|---|---|
| CA | 2224615 | 6/1999 |
| WO | WO 2007/102819 | 9/2007 |
| WO | WO 2011/082209 | 7/2011 |

OTHER PUBLICATIONS

Sinnott, R. K., Chemical engineering Design, vol. 6, 4th ed., p. 402, Elsevier, 2005 (2 pp.).
Information about Related Patents and Patent Applications.
Acetone MSDS, Sigma-Aldrich, Apr. 19, 2012 (8 pp.).
Bezene MSDS, Sigma-Aldrich, Apr. 27, 2012 (9 pp.).
Biodiesel Processing, Mar. 22, 2004 (3 pp.).
Biodiesel Processing, biodiesel Handout for 2005 New Hampshire Science Tearher's Association Workshop UNH Biodiesel Group, http://www.unh.edu/p2/biodiesel, 2005 (27 pp.).
Cohen et al., "Degradation of Coal by Fungi Plyporus Versicolor and Poria Monticola," Appl. Enviom. Microbiol., 44(1):Jul. 23-27, 1982 (5 pp.).
Desolventizer-Toaster, Crown Iron Works Company, PDF file created Feb. 16, 2010, (3 pp.).
Flores III, Heavy Oil Upgrading, Technology Today, Spring 2010 (6 pp.).

(Continued)

*Primary Examiner* — Randy Boyer

(57) ABSTRACT

A method of extracting bitumen from bituminous material. In some embodiments, the method may include loading a bitumen material in a column, followed by feeding a first quantity of solvent into the column. The method may also include collecting the bitumen-enriched solvent exiting the column. A quantity of the bitumen-enriched solvent may then be fed into the column. In some embodiments, the method may include simultaneously loading bitumen material and a solvent in a column, followed by feeding additional solvent into the column. The method may also include collecting bitumen-enriched solvent exiting the column, and feeding a quantity of the bitumen-enriched solvent into the column.

14 Claims, 5 Drawing Sheets

(56) References Cited

U.S. PATENT DOCUMENTS

| | | | |
|---|---|---|---|
| 5,670,345 | A | 9/1997 | Srivastava et al. |
| 5,702,612 | A | 12/1997 | Wang |
| 5,728,202 | A | 3/1998 | Nelson et al. |
| 5,795,466 | A | 8/1998 | Kelebek et al. |
| 5,798,137 | A | 8/1998 | Lord et al. |
| 5,849,201 | A | 12/1998 | Bradley |
| 5,872,289 | A | 2/1999 | Appleby et al. |
| 5,876,592 | A | 3/1999 | Tipman et al. |
| 5,896,435 | A | 4/1999 | Gautier et al. |
| 5,961,786 | A | 10/1999 | Freel et al. |
| 5,968,349 | A | 10/1999 | Duyvesteyn et al. |
| 5,992,050 | A | 11/1999 | Kemper et al. |
| 6,007,709 | A | 12/1999 | Duyvesteyn et al. |
| 6,036,849 | A | 3/2000 | Rippetoe et al. |
| 6,074,558 | A | 6/2000 | Duyvesteyn et al. |
| 6,106,787 | A | 8/2000 | Rippetoe |
| 6,214,213 | B1 | 4/2001 | Tipman et al. |
| 6,320,148 | B1 | 11/2001 | Yoon et al. |
| 6,352,639 | B2 | 3/2002 | Ito et al. |
| 6,427,843 | B1 | 8/2002 | Clark |
| 6,514,310 | B2 | 2/2003 | Allemand et al. |
| 6,589,417 | B2 | 7/2003 | Taciuk et al. |
| 6,595,163 | B2 | 7/2003 | Dumaz et al. |
| 6,764,542 | B1 | 7/2004 | Lackey et al. |
| 6,768,015 | B1 | 7/2004 | Luxem et al. |
| 6,793,079 | B2 | 9/2004 | Khan et al. |
| 6,822,105 | B1 | 11/2004 | Luxem et al. |
| 6,827,786 | B2 | 12/2004 | Lord |
| 6,827,841 | B2 | 12/2004 | Kiser et al. |
| 6,871,743 | B2 | 3/2005 | Yoon et al. |
| 6,936,227 | B1 | 8/2005 | De Souza et al. |
| 6,965,044 | B1 | 11/2005 | Hammond et al. |
| 6,989,091 | B2 | 1/2006 | Jorgensen |
| 7,008,528 | B2 | 3/2006 | Mitchell et al. |
| 7,011,749 | B2 | 3/2006 | Hayes et al. |
| 7,018,435 | B1 | 3/2006 | Wentinck |
| 7,097,675 | B2 | 8/2006 | Detering et al. |
| 7,384,557 | B2 | 6/2008 | Phillips et al. |
| 7,438,807 | B2 | 10/2008 | Garner et al. |
| 7,464,756 | B2 | 12/2008 | Gates et al. |
| 7,585,407 | B2 | 9/2009 | Duyvesteyn |
| 7,588,682 | B2 | 9/2009 | Norman |
| 7,618,597 | B2 | 11/2009 | Duyvesteyn |
| 7,811,444 | B2 | 10/2010 | Duyvesteyn et al. |
| 2005/0070218 | A1 | 3/2005 | Phillips et al. |
| 2007/0170095 | A1 | 7/2007 | Freel et al. |
| 2008/0156702 | A1 | 7/2008 | Duyvesteyn |
| 2008/0242875 | A1 | 10/2008 | Hong et al. |
| 2009/0090654 | A1 | 4/2009 | Duyvesteyn et al. |
| 2009/0145809 | A1 | 6/2009 | Ledbetter et al. |
| 2009/0294332 | A1 | 12/2009 | Ryu |

OTHER PUBLICATIONS

Gallmetzer et al., "Efflux of Organic Acids in Penicillium Simplicissimum is an Energy-Spilling Porcess . . . ," Microbiology 148:1143-1149, 2002 (7 pp.).

Hong et al., "A Polar-Nonpolar, Acetic Acid/Heptane, Solvent Medium for Degradation of Pyrene by Ozone," Ind. Eng. Chem. Res. 43:7710-7715, 2004 (6 pp.).

Houdaille, "Jet Pump Techinical Data—Puming Liquids," pp. 1-11, 1982 (12 pp.).

International Search Report, PCT/US2010/62133, Aug. 30, 2011 (3 pp.).

International Search Report, PCT/US10/43822, Nov. 29, 2010 (4 pp.).

International Search Report, PCT/US10/43082, Sep. 14, 2010 (11 pp.).

International Search Report and Written Opinion, PCT/US09/35552, Apr. 17, 2009 (8 pp.).

International Search Report and Written Opinion, PCT/US07/19222, Apr. 22, 2008 (8 pp.).

International Search Report, PCT/US2005/34092, Jul. 26, 2007 (6 pp.).

International Search Report, PCT/US2006/08263, Oct. 23, 2006 (5 pp.).

International Search Report, PCT/US2005/36728, Aug. 8, 2005 (8 pp.).

Lewis, "Liquefied Petroleum Gas," Hawley's condensed Chemical Dic tionary (14th Edition), John Wiley Sons., 2002 (1 p.).

Rogoff et al., "The Microbiology of Coal," Bureau of Mines, U.S. Dept. of the Interior, Region V, Bruceton, PA,73:264-268, Aug. 23, 1956 (5 pp.).

Soygold, Environmental Solutions to Your Market Challenges, http://www.soygold.com/applications.htm, printed Mar. 6, 2007 (2 pp.).

Toluene MSDS, Sigma-Aldrich, Apr. 24, 2012 (8 pp.).

Vicente et al., "A comparative Study of Vegetable Oils for Biodiesel Production in Spain," Energy& Fuels, 20:394-398, 2006 (published on Web Nov. 8, 2005) (5 pp.).

* cited by examiner

METHODS FOR OBTAINING BITUMEN FROM BITUMINOUS MATERIALS

This application claims priority to U.S. Provisional Patent Application No. 61/511,906, filed Jul. 26, 2011, and U.S. Provisional Patent Application No. 61/525,567, filed Aug. 19, 2011. Each application is incorporated herein by reference in its entirety.

BACKGROUND

Bitumen is a heavy type of crude oil that may be found in naturally occurring geological materials such as oil sands, black shales, coal formations, and weathered hydrocarbon formations contained in sandstones and carbonates. Some bitumen may be described as flammable brown or black mixtures or oil-like hydrocarbons derived naturally or by distillation from petroleum. Bitumen can be in the form of anywhere from a viscous oil to a brittle solid, including asphalt, oils, and natural mineral waxes. Substances containing bitumen are often referred to as bituminous, e.g., bituminous coal, bituminous oil, or bituminous pitch. At room temperature, the flowability of some bitumen is much like cold molasses. Bitumen may be processed to yield oil and other commercially useful products, primarily by cracking the bitumen into lighter hydrocarbon material.

As noted above, oil sands represent one of the well known sources of bitumen. Oil sands typically include bitumen, water and mineral solids. The mineral solids typically include inorganic solids such as coal, sand, and clay. Oil sand deposits are found in many parts of the world, including North America. One of the largest oil sands deposits is in the Athabasca region of Alberta, Canada. In the Athabasca region, the oil sands formation can be found at the surface, although it may also be buried two thousand feet below the surface overburden or more. Oil sands deposits are measured in barrels equivalent of oil. It is estimated that the Athabasca oil sands deposit contains the equivalent of about 1.7 to 2.3 trillion barrels of oil. Global oil sands deposits have been estimated to contain up to 4 trillion barrels of oil. By way of comparison, the proven worldwide oil reserves are estimated to be about 1.3 trillion barrels.

The bitumen content of oil sands can vary widely. In some oil sands, the bitumen content ranges from approximately 3 wt % to 21 wt %, with a typical content of approximately 12 wt %. Accordingly, an initial step in deriving oil and other commercially useful products from bitumen typically requires extracting bitumen from the naturally occurring geological material so that the bitumen may then be upgraded. In the case of oil sands, this may include separating the bitumen from the mineral solids and other components of oil sands.

SUMMARY

Disclosed are embodiments of a method for obtaining bitumen from bituminous materials. In some embodiments, the method for obtaining bitumen from bituminous materials may include extracting bitumen from bituminous material loaded in a vertical column. The bituminous material may be loaded in the vertical column without the need for a solvent mixing pretreatment step, which may thereby simplify the method and reduce the overall cost of performing the method.

In some embodiments, the method may include loading bitumen material in a column. The method may also include feeding a first quantity of solvent into the column. Additionally, the method may include collecting bitumen-enriched solvent exiting the column. Furthermore, the method may include feeding a quantity of the bitumen-enriched solvent into the column. In some embodiments, the column is free of obstructions, such as platforms or stages.

In some embodiments, the method may include simultaneously loading bitumen material and a solvent in a column. The method may also include feeding additional solvent into the column. Additionally, the method may include collecting bitumen-enriched solvent exiting the column. Furthermore, the method may include feeding a quantity of the bitumen-enriched solvent into the column. In some embodiments, the column is free of obstructions, such as platforms or stages.

It is to be understood that the foregoing is a brief summary of various aspects of some disclosed embodiments. The scope of the disclosure need not therefore include all such aspects or address or solve all issues noted in the background above. In addition, there are other aspects of the disclosed embodiments that will become apparent as the specification proceeds.

The foregoing and other features, utilities, and advantages of the subject matter described herein will be apparent from the following more particular description of certain embodiments as illustrated in the accompanying drawings. In this regard, it is to be understood that the scope of the invention is to be determined by the claims as issued and not by whether given subject includes any or all features or aspects noted in this Summary or addresses any issues noted in the Background.

BRIEF DESCRIPTION OF THE DRAWINGS

The preferred and other embodiments are disclosed in association with the accompanying drawings in which.

DETAILED DESCRIPTION

Before describing the details of the various embodiments herein, it should be appreciated that the terms "solvent," "a solvent" and "the solvent" can include one or more than one individual solvent compound unless expressly indicated otherwise. Mixing solvents that include more than one individual solvent compound with other materials can include mixing the individual solvent compounds simultaneously or serially unless indicated otherwise. It should also be appreciated that the term "oil sands" includes oil sands. The separations described herein can be partial, substantial or complete separations unless indicated otherwise. All percentages recited herein are weight percentages unless indicated otherwise.

Oil sands are used throughout this disclosure as a representative bitumen material. However, the methods disclosed herein are not limited to processing of oil sands. Any bitumen material may be processable by the methods disclosed herein.

Figure 1:
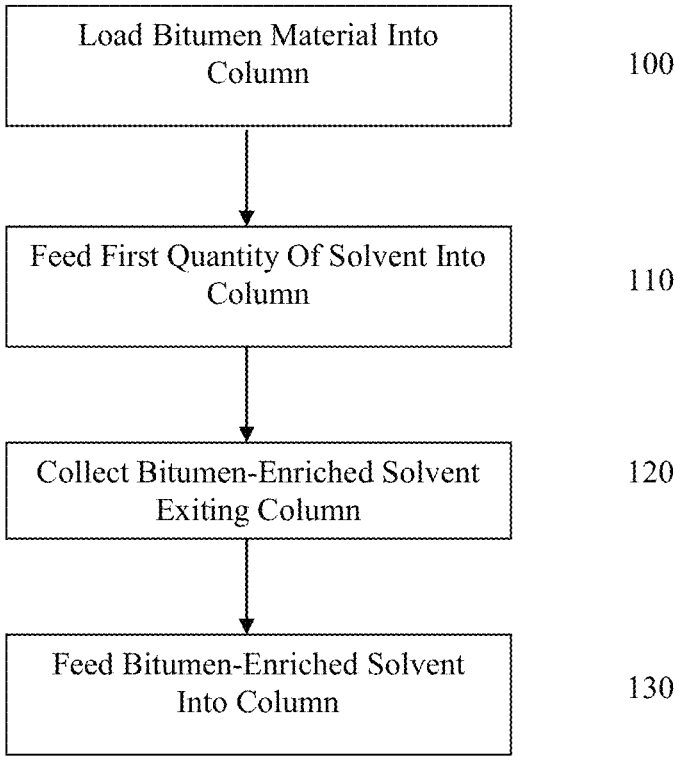
FIG. 1 is a flow chart detailing a method for obtaining bitumen from bituminous material as disclosed herein.

With reference to FIG. 1, a first embodiment of a method for obtaining bitumen from bituminous materials includes a step 100 of loading bitumen material in a column, a step 110 of feeding a first quantity of solvent into the column, and a step 120 of collecting bitumen-enriched solvent exiting the column. An optional step 130 of feeding the bitumen-enriched solvent into the column can also be included.

With reference to the step 100 of loading bitumen material in a column, the bitumen material can be any material that includes at least some bitumen content. Exemplary bitumen materials include, but are not limited to, oil sands, black shales, coal formations, and hydrocarbon sources contained in sandstones and carbonates. The bitumen material can be obtained by any known methods for obtaining bitumen material, such as by surface mining or underground mining. The bitumen content of the bitumen material suitable for use in this method is also not limited.

The column into which the bitumen material is loaded can be any type of column suitable for carrying out bitumen extraction on bituminous material. In some embodiments, the column has a generally vertical orientation. The vertical orientation may include aligning the column substantially perpendicular to the ground, but also may include orientations where the column forms angles less than 90° with the ground. In some embodiments, the column can oriented at an angle anywhere within the range of from about 1° to 90° with the ground. In a preferred embodiment, the column is oriented at an angle anywhere within the range of from about 15° to 90° with the ground. In some embodiments, the interior chamber of the column is open, with few or no obstructions (such as, e.g., platforms or stages).

The material of construction for the vertical column is also not limited. Any material that will hold the bitumen material within the column can be used. The material may also preferably be a non-porous material such that various solvents fed into the column may only exit the column from one of the ends of the vertical column. The material can be a corrosive-resistant material so as to withstand the potentially corrosive components fed into the column as well as any potentially corrosive materials.

The shape of the column is not limited to a specific configuration. Generally speaking, the column can have two ends opposite one another, designated a top end and a bottom end. The cross-section of the column can be any shape, such as a circle, oval, square, rectangle, or the like. In some embodiments, the cross-section of the column changes along the height of the column, including both the shape and size of the column cross-section. The column can be a straight line column having no bends or curves along the height of the vertical column. Alternatively, the column can include one or more bends or curves.

A wide variety of dimensions can be used for the column, including the height, inner cross sectional diameter and outer cross sectional diameter of the column. In some embodiments, the ratio of height to inner cross sectional diameter ranges from 0.25:1 to 15:1.

In some embodiments, the interior of the column is unobstructed. The column can be free of partitions or other objects that would divert the material introduced into the column. In this manner, the amount of bitumen material loaded in the column can be maximized and natural flow of solvent through the bitumen material loaded in the column can be guided primarily by the void spaces in bitumen material.

The bitumen material can be loaded in the column according to any suitable method. For example, in some embodiments, the bitumen material is generally loaded in the column by introducing the bitumen material into the column at the top end of the column. The bottom end of the column can be blocked, such as by a removable plug or by virtue of the bottom end of the column resting against the floor. In some embodiments, a metal filter screen at the bottom end of the column can be used to maintain the bitumen material in the vertical column. In such configurations, introducing the bitumen material at the top end of the column fills the column with bitumen material.

In some embodiments, the bitumen material is loaded into the column by pouring the bitumen material into the top end of the column. In one example, the bitumen material can be transported to the column via a conveyor having one end positioned over the top end of the column. In such a configuration, the bitumen material falls into the column after it is transported over the end of the conveyor positioned over the column. Manual methods of loading bitumen material into the column can also be used, such as mechanical or manual shoveling the bitumen material into column. For larger diameter columns, automatic distribution systems can be used, such as the systems disclosed in U.S. Pat. Nos. 4,555,210 and 6,729,365.

The amount of bitumen material loaded in the column may be such that the bitumen material substantially fills the column with bitumen material. In some embodiments, the bitumen material may be added to the column to occupy 90% or more of the volume of the column. In some embodiments, the bitumen material may not be filled to the top of the column so that room is provided to feed solvent into the column.

Generally speaking, the loading of bitumen material into the column as described above will lead to a well packed column. That is to say, the bitumen material will settle into the vertical column in manner that results in minimal void spaces within vertical column. If the vertical column is not well packed (i.e., includes too many void spaces or overly large void spaces), solvent added to the column to dissolve and extract bitumen (a step of the method described in greater detail below) will flow through the vertical column too quickly. When solvent passes through the bitumen material too quickly, an insufficient amount of solvation of bitumen occurs and a generally poor extraction process results.

In some embodiments, additional steps may be taken to ensure a packed column of bitumen material and thereby promote sufficient solvation of bitumen when solvent is passed through the bitumen material loaded in the column. In some embodiments, the size of individual pieces of the bitumen material can be reduced prior to loading the bitumen material into the column. Reducing the size of the pieces of the bitumen material may help the pieces of the bitumen material settle closer to each other in the column and avoid the formation of void spaces or overly large void spaces. The pieces of bitumen material can be reduced in size by any suitable procedure, such as by crushing or grinding the pieces. In some embodiments, the pieces are reduced in size based on the diameter of the column used. In some embodiments, the pieces are reduced to a size that is 15% or less than the diameter of the column. For example, when the column has a diameter of 40 inches, the pieces can be reduced to a size of 6 inches or less. For commercial operation the material is usually reduced to nominally 8 inches or less for ease of handling and to ensure dissolution within adequate retention time.

In other embodiments, the bitumen material can be packed down once it is loaded in the column in order to reduce or eliminate void spaces. Any method of packing down the bitumen material may be used. In some embodiments, a piston or the like is inserted into the top end of the vertical column and force is applied to the piston to move the piston downwardly into the column in order to pack down the bitumen material. The piston may apply pressure downwardly on the bitumen material loaded in the column as a consistent application of downward pressure or as a series of downward blows. Alternatively, a vibration device, such as the device disclosed in U.S. Pat. No. 3,061,278 can be used to pack down the bitumen material. Packing down of the bitumen material can also be performed manually. Additionally, packing may be allowed to occur under its own weight, including after solvent has been added to the bitumen material. After solvent has been added to the bitumen material and the bitumen has become partially solvated, the mixture of solvent and bitumen material can compact and slump down under its own weight. After the bitumen material is packed down once, additional bitumen material can be added to the column to take up the space in the column created by the packing. The packing down of bitumen material and adding of further bitumen material can be repeated one or more times.

In step 110, a first quantity of solvent is fed into the column. One objective of adding solvent to the column is to dissolve the bitumen content of the bitumen material loaded in the column. Put another way, the solvent is added to the column to reduce the viscosity of the bitumen and allow it to flow through and out of the column. Without the solvent, the bitumen content of the bitumen material at room temperature may have a viscosity in the range of 100,000 times that of water and will not flow through the column. The addition of the solvent reduces the viscosity of the bitumen to a flowable state and allows it to travel out of the column with the first solvent.

Accordingly, the solvent used in step 110 can be any suitable solvent for dissolving or reducing the viscosity of the bitumen in the bitumen material. In some embodiments, the solvent includes a hydrocarbon solvent. Any suitable hydrocarbon solvent or mixture of hydrocarbon solvents can be used. The hydrocarbon solvent or mixture of hydrocarbon solvents can be economical and relatively easy to handle and store. The hydrocarbon solvent or mixture of hydrocarbon solvents may also be generally compatible with refinery operations.

In certain embodiments, the solvent is a paraffinic solvent. Any paraffinic solvent suitable for use in dissolving bitumen can be used. In some embodiments, the paraffinic solvent is pentane. Other suitable paraffinic solvents include, but are not limited to, ethane, butane, hexane and heptane It should be appreciated that the paraffinic solvent need not be 100% paraffinic solvent. Instead, the paraffinic solvent may include a mixture of paraffinic and non-paraffinic compounds. For example, the solvent can include greater than zero to about 100 wt % paraffinic compounds, such as approximately 10 wt % to 100 wt % paraffinic compounds, or approximately 20 wt % to 100 wt % paraffinic compounds.

In some embodiments, the solvent added into the column includes a bitumen content. The solvent might include a bitumen content when the solvent added into the column in step 110 is solvent that has already been used to extract bitumen from a bitumen material. As described in greater detail below, solvent that passes through bitumen material in a column may exit the column as bitumen-enriched solvent, and this bitumen-enriched solvent may be used to carry out step 110 being performed on a different column packed with bitumen material or on a second quantity of bitumen material loaded in the same column. For example, bitumen-enriched solvent collected from the bottom of a first column as described in greater detail below may be added to bitumen material loaded in a second column in order to carry out step 110 in the second column, or may be added to a second quantity of bitumen material loaded in the first column after the first quantity of bitumen material is discharged from the first column.

The solvent can be fed into the column in a wide variety of ways. For example, in some embodiments, solvent is injected into the bitumen material loaded in the column at various locations along the height of the column. Such injection may be accomplished through the use of column side injectors that are spaced along the height of the column and extend through the side wall of the column and into the interior of the column where the bitumen material is loaded. Injection of solvent at various locations along the height of the column can also be accomplished by using a single pipe that extends down into the column and includes various locations along the length of the pipe where solvent can exit the pipe. The pipe can be positioned down the center of the column or off to the side of the column.

In configurations such as those described above, the solvent may be injected into the column beginning with the lowest injection positions first and moving upwardly through the column. Injecting solvent into the column in this manner and in this order helps to ensure percolation of solvent through the column and prevents the column from plugging up as described in greater detail below.

Figure 5:
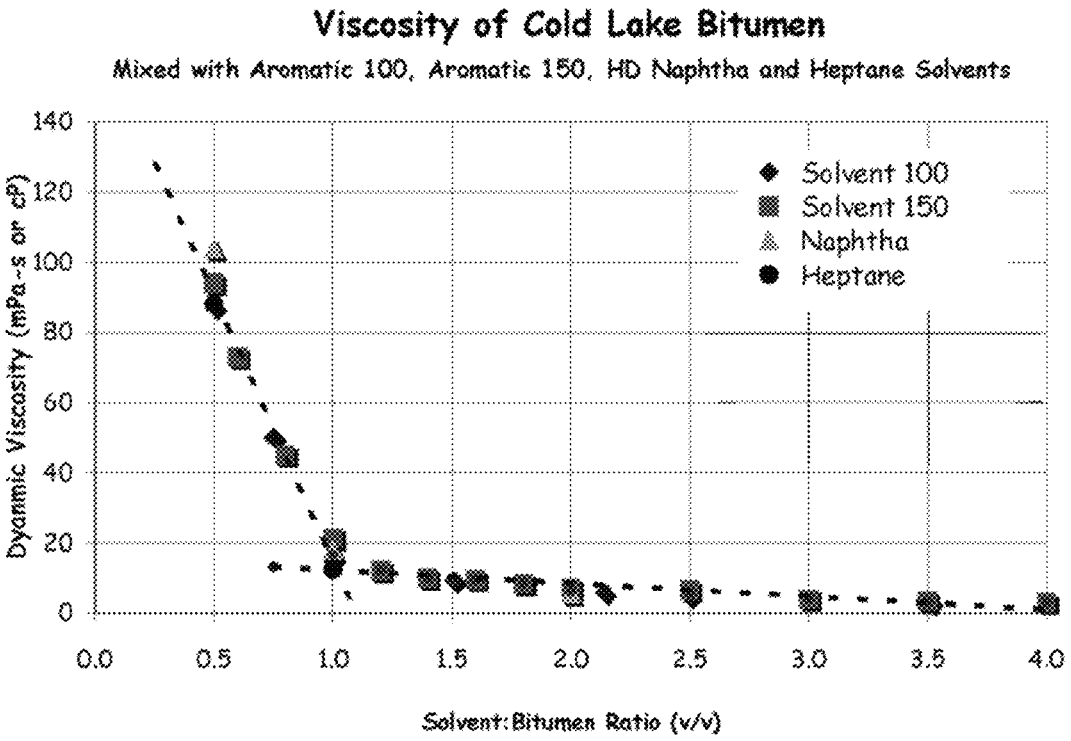
FIG. 5 is a graph showing the relationship between the S:B ratio and the dynamic viscosity of bitumen when using various types of solvents.

With reference to FIG. 5, it has been determined that the amount of the solvent added to the column can be any amount where the ratio of solvent to the bitumen content of the bitumen material (on a v/v basis) (herein referred to as "S:B") is greater than 1. If a S:B ratio less than 1 is used, the viscosity of the bitumen in the solvent is not sufficiently reduced to provide for an adequate flow of bitumen through the packed column. As shown in FIG. 5, the viscosity of the bitumen in the solvent sharply increases as the S:B ratio falls below 1, thereby making S:B ratios less than 1 unsuitable for the method described herein. Conversely, the viscosity of the bitumen only gradually decreases as the S:B ratio rises above 1, thereby making S:B ratios greater than 1 suitable for use in the method described herein.

As discussed above, the solvent can be injected into the column starting from the bottom of the column and moving upwards to the top of the column. Injecting the solvent into the column in this manner may beneficially prevent the column from plugging by ensuring that the S:B ratio does not fall below 1 at any location inside the column. If solvent is added at the top of the column at an S:B ratio of 1, a portion of the solvent may flow down the column to a location where the S:B ratio is below 1 and therefore does not sufficiently reduce the viscosity of the bitumen to flow through the column. This may result in the column plugging up. By introducing the solvent at an S:B ratio of at least 1 at the bottom of the column and subsequently and sequentially adding solvent at higher positions along the column at an S:B ratio greater than 1, portions of the injected solvent may not be able to flow downwardly to a location in the column where the S:B ratio is not greater than 1 and plug the column. Accordingly, the manner of injecting the solvent into the column described in greater detail above may avoid problems related to column plugging.

If the column does become plugged due to the S:B ratio falling below 1 at a location within the column, steps can be taken to unplug the column. More specifically, the location of the plug can be identified and additional solvent can be injected into the column at the injection point just above the plug (when the column is operated in a downward flow mode). The additional solvent injected into the column can be injected into the column in such a manner as to close off the bottom of the column and force the solvent to flow upwardly though the column. For example, increasing the flow rate and pressure of the injected solvent may result in closing off the bottom of the column. The upwardly moving solvent may then displace and dissolve the bitumen phase causing the plug due to the viscosity issues.

The solvent fed into the column flows downwardly through the bitumen material loaded in the column. The solvent flows downwardly through the height of the column via small void spaces in the bitumen material. The solvent may travel the flow of least resistance through the first mixture. As the solvent flows through the bitumen material, the solvent can dissolve bitumen contained in the bitumen material and thereby form bitumen-enriched solvent. In some embodiments, 90%, preferably 95%, and most preferably 99% or more of the bitumen in the bitumen material is dissolved in the solvent and becomes part of the bitumen-enriched solvent phase. In some embodiments, the solvent may be light enough to precipitate asphaltenes as a means to reject the heavy portion of the bitumen within the bitumen material. In such embodiments the total bitumen dissolved will be lower by virtue of the asphaltene component rejection.

With continuing reference to FIG. 1, in some embodiments the first quantity of solvent added into the packed column at step 110 is added into the packed column in two stages. In a first stage, a portion of the first quantity of solvent added to the packed column serves primarily to reduce the viscosity of the bitumen content of the bitumen material loaded in the column and create a diluted bitumen (also known as "dilbit") phase that may flow downwardly and out of the column. In a second stage, the remaining portion of the first quantity of solvent added to the packed column serves primarily to displace out of the column any dilbit that did not flow out of the column with the rest of the dilbit formed upon the addition of the first portion of the first quantity of solvent.

The division of the first quantity of solvent into a first stage amount and a second stage amount is not limited. In some embodiments, from about 30% to about 75% of the first quantity of solvent makes up the first stage amount of solvent and from about 25% to about 70% of the first quantity of solvent makes up the second stage amount of the solvent.

As noted above, the material leaving the column upon addition of the first stage amount of solvent includes bitumen dissolved in solvent. In some embodiments, the bitumen-enriched solvent leaving the column includes from about 25% to about 75% bitumen and from about 25% to about 75% solvent.

The material leaving the column upon addition of the remaining portion of the first quantity of solvent can also include bitumen dissolved in solvent, but the amount of bitumen in the solvent may be significantly less than in the bitumen-enriched solvent leaving the column after the addition of the first stage of solvent. This is due to the relatively minor amount of dilbit remaining in the column after the addition of the first stage of the solvent and the relatively high amount of solvent added to the column as the remaining portion of the first quantity of the solvent. In some embodiments, the material leaving the column after the addition of the remaining portion of the first quantity of solvent includes from about 60% to about 95% solvent and from about 5% to about 40% bitumen.

The material leaving the column during the two stage addition of the solvent can be collected separately so the two streams do not intermix. The bitumen-enriched solvent collected first can be collected and treated as final product rather than being recycled back into the column. The material collected second can be used as the bitumen-enriched solvent that is recycled back into the column in optional step 130 described in greater detail below.

The bitumen-enriched solvent that flows downwardly through the height of the column may exit the column at, for example, the bottom end of the column. Accordingly, a step 120 of collecting the bitumen-enriched solvent exiting the column is performed. Any method of collecting the bitumen-enriched solvent can be used, such as by providing a collection vessel at the bottom end of the column. The bottom end of the column can include a metal filter screen having a mesh size that does not permit bitumen material to pass through but which does allow for bitumen-enriched solvent to pass through and collect in a collection vessel located under the screen. Collection of bitumen-enriched solvent can be carried out for any suitable period of time. In some embodiments, collection is carried until the bitumen-enriched solvent phase substantially or completely stops exiting the column. In some embodiments, collection is carried out for from 2 to 60 minutes.

In some embodiments, the bitumen-enriched solvent collected in step 120 contains from about 10 wt % to about 60 wt % bitumen and from about 40 wt % to about 90 wt % solvent. Minor amounts of non-bitumen material can also be included in the bitumen-enriched solvent phase.

In some embodiments, a portion of the solvent fed into the column does not travel all the way through the column. Rather, a portion of the first solvent is trapped in the bitumen material loaded in the column. The solvent trapped in the bitumen material may or may not have bitumen dissolved therein. In some embodiments, the material loaded in the column after bitumen-enriched solvent phase has been collected includes from about 75 wt % to about 95 wt % non-bitumen components of the bitumen material, from about 4 wt % to about 20 wt % solvent and from 1 wt % to 15 wt % bitumen and/or precipitated asphaltenes. Accordingly, after addition of solvent as in step 110 and the collection of bitumen-enriched solvent in step 120, the material loaded in the column can be considered solvent-wet tailings.

In some embodiments, the flow of solvent through the column and the removal of bitumen-enriched solvent phase are aided by adding a pressurized gas into the column either before or after solvent is fed into the column. Applying a pressurized gas over the bitumen material loaded in the column can facilitate the separation of the bitumen-enriched solvent from the non-bitumen components of the bitumen material loaded in the vertical column. Once liberated and having a much reduced viscosity due to the addition of the solvent, the bitumen-enriched solvent phase can be pushed out of the column either by the continual addition of pressurized gas and/or by feeding additional solvent into the column. The addition of additional solvent or bitumen-enriched solvent collected in step 120 can displace the liberated bitumen-enriched solvent from the first solvent-wet tailings by providing a driving force across a filtration element (i.e., the non-bituminous components of the bitumen material). Any suitable gas may be used. In some embodiments, the gas is nitrogen, carbon dioxide, or steam. In some embodiments, the gas is solvent added as a vapor or in a superheated condition to aid the removal of residual solvated bitumen or residual solvent liquid. The solvent vapor aids in reducing final solvent content of the bitumen depleted material as pore spaces or voids are only filled with vapor and not liquid. This has added benefit in any subsequent water washing stage. The gas can also be added over the bitumen material loaded in the vertical column in any suitable amount. In some embodiments, 1.8 $m^3$ to 10.6 $m^3$ of gas per ton of bitumen material is used. This is equivalent to a range of about 4.5 liters to 27 liters of gas per liter of bitumen material. In certain embodiments, 3.5 $m^3$ of gas per ton of bitumen material is used.

After collecting bitumen-enriched solvent, a step 130 of feeding the collected bitumen-enriched solvent back into the column can optionally be performed. The bitumen-enriched solvent phase can be fed into the column in a similar or identical manner as described above with respect to feeding a first quantity of solvent into the column. The bitumen-enriched solvent may be fed back into the column "as is" or may be diluted with additional solvent prior to feeding the bitumen-enriched solvent back into the column. The amount of bitumen-enriched solvent phase fed into the column is not limited. In some embodiments, the bitumen-enriched solvent fed into the column is approximately 0.5 to 4.0 times the amount of bitumen by volume contained in the original bitumen material.

In some embodiments, the bitumen-enriched solvent fed into the column behaves much like the first quantity of solvent fed into the column. The bitumen-enriched solvent flows downwardly through the column, dissolving additional bitumen still contained in the column and forcing entrapped bitumen-enriched solvent out of the column. The bitumen-enriched solvent eventually may exit the column, where it may be collected in a similar or identical manner to the collection step 120 described above.

The steps of collecting bitumen-enriched solvent and feeding bitumen-enriched solvent back into the column can be repeated one or more times in order to remove greater amounts of bitumen from the bitumen material loaded in the column. In some examples, the steps of collecting the bitumen-enriched solvent and feeding the bitumen-enriched solvent into the column are repeated until less than 1 wt % bitumen of the bitumen material is remaining in the column.

After the steps of collecting the bitumen-enriched solvent phase and feeding the bitumen-enriched solvent phase into the column have been performed, additional steps may be taken to clean the solvent-wet tailings remaining in the column of any residual first solvent contained therein. In some embodiments, the cleaning steps may include injecting water into the column in an effort to displace residual solvent remaining in the column.

The amount of the water added to the column can be sufficient to effectively displace at least a portion, or desirably all, of the solvent entrapped in the material loaded in the column, including entrained solvent having bitumen dissolved therein. The amount of water added to the column may be approximately 0.5 to 4 times the amount of bitumen by volume originally contained in the bitumen material.

In some embodiments, the addition of water to the column results in the removal of 95% or more of the solvent entrapped in the first solvent-wet tailings. The solvent may leave the column as a mixture of water and solvent. The solvent-water mixture can include from about 10 wt % to about 40 wt % solvent and from about 60 wt % to about 90 wt % water, and may also have a relatively minor bitumen content. The solvent-water mixture can be collected and subjected to further processing to separate the two components.

As with the possible two stage addition of solvent described in greater detail above, the water can also be added to the column in two stages. More specifically, the water can be added as a liquid in a first stage and as a superheated gas in a second stage. The addition of water as a liquid in the first stage can result in the displacement of a majority of the solvent from the column as described above and can result in a first solvent-water mixture exiting the column. The addition of water as a superheated gas in the second stage may behave much like the pressurized gas optionally injected into the column as described in greater detail above. The steam may remove any entrained solvent still located in the column after the first stage addition of water. Additionally, the steam may heat the solvent contained in the column and convert the solvent to a vapor to help in the removal of the solvent from the column. Accordingly, the material leaving the column upon introduction of the second stage of water into the column may include both liquid solvent displaced by the steam and gaseous solvent that was vaporized by the steam. Additionally, some of the steam may condense as it passes through the column, and therefore some of the steam added into the column as part of the second stage may exit the column as a condensed liquid.

The removal of solvent from the column through the addition of water can result in the production of solvent-dry, stackable tailings. The solvent-dry, stackable tailings may generally include inorganic solids, such as sand and clay, water content, and little or no solvent. In some embodiments, the solvent-dry, stackable tailings are considered solvent-dry because they include less than 0.1 wt % total solvent. Similarly, the solvent-dry, stackable tailings may be considered stackable because they include a water content in the range of from 2 wt % to 15 wt %. This range of water content may reduce or eliminate the problem of tailings dust during transportation and deposition of the tailings. Further, this range or water content may provide for solvent-dry, stackable tailings that may be deposited without requiring retention infrastructure to maintain the tailings in place. The solvent-dry, stackable tailings can include less than 2 wt % bitumen and asphaltene (and may contain up to 15 wt % bitumen and asphaltenes if the latter is being rejected as of no commercial value).

In some embodiments, the steps described above involve the use of only a single solvent. That is to say, only one solvent is present in the system throughout the method. While both pure solvent and bitumen-enriched solvent can be used, the solvent of both the streams can be the same single solvent used exclusively in the method and system.

Figure 2:
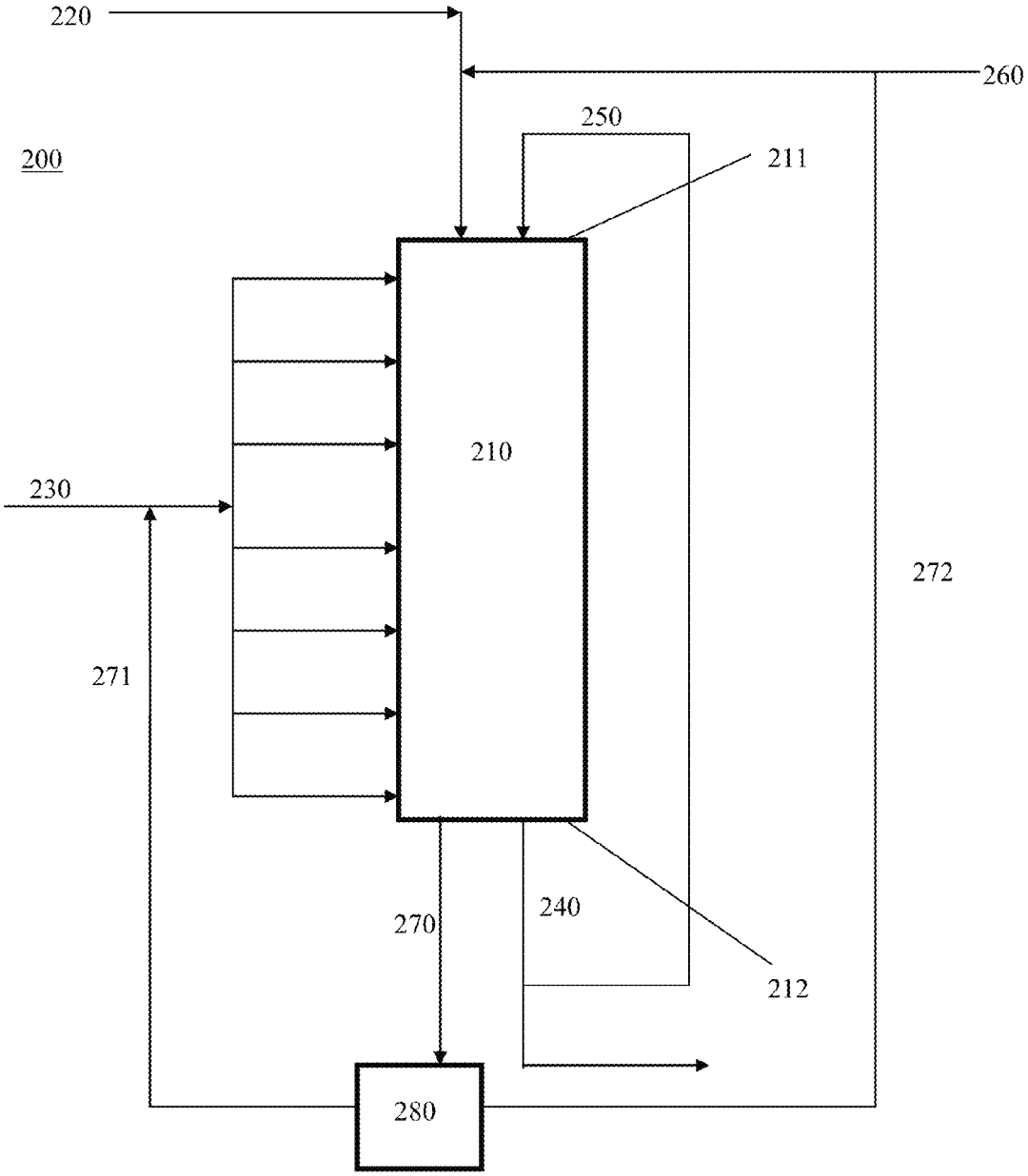
FIG. 2 is a schematic diagram for a system and method for obtaining bitumen from bituminous material as disclosed herein.

With reference to FIG. 2, a system 200 for carrying out the method described above is illustrated. The system includes a column 210 in which bitumen extraction takes place. The column 210 can be vertically oriented and have a top end 211 and a bottom end 212 opposite the top end 211, and can be free of any obstructions in the interior of the column 210. Ambient temperature or pre-heated bitumen material 220 can fed into the top end 211 of the column 210, such as by using a conveyor having one end positioned over the top end 211 of the column 210 to convey bitumen material 220 into the column 210. After bitumen material 220 is fed into the column 210, the bitumen material 220 can optionally be packed down into the column 210, such as by applying downward force to a piston positioned in the column 210. Additional bitumen material 220 can be fed into the column 210 and packed down into the column 210 after the initial loading and packing down steps have taken place.

A first quantity of solvent 230 is then fed into the column 210. As shown in FIG. 2, the solvent 230 is injected into the column 210 from the side of the column 210 at several positions along the height of the column 210. Injection of the solvent 230 can begin at the lowest injection point and proceed upwardly to the upper most injection point. Injection of the solvent 230 can also take place in two stages. The solvent 230 dissolves bitumen contained in the bitumen material 220 as the solvent 230 flows downwardly through the column 210. A bitumen-enriched solvent 240 exits the column 210 at the bottom end 212 of the column 210, where it is collected. The collected bitumen-enriched solvent 240 can optionally be fed back into the column 210 (with or without the addition of further solvent) as a recycle stream 250 in order to extract further bitumen from the bitumen material 220. The collection and recycling of bitumen-enriched solvent 240 back into the column 210 can be performed one or more times. Once a sufficient number of recycling cycles has taken place, the bitumen-enriched solvent 240 is collected and separated into bitumen and solvent. The solvent can be reused in the method, such as a make-up stream to the solvent 230 fed into the column, and the bitumen can be subjected to further processing to upgrade the bitumen into commercially useful product.

A portion of the solvent 230 remains in the now bitumen-depleted bitumen material 220 loaded in the column 210. The solvent 230 remaining in the column is removed from the column by feeding water 260 into the top end 211 of the column 210 or in a similar manner as the solvent 230 was injected into the column 210 (i.e., from the side of the column and in an upwardly fashion). Like solvent 230, the water 260 may be added to the column 210 in two stages, including where the water 260 is added into the column 210 as steam in the second stage. The water 260 displaces solvent 230 out of the column 210 as it flows downwardly through the column 210. A solvent-water mixture 270 exits at the bottom end 212 of the column 210, where it is collected and transported to a separation unit 280. The separation unit 280 separates the solvent-water mixture 270 into a solvent 271 and water 272, and both the solvent 271 and the water 272 can be reused in the method, such as make-up streams for the solvent 230 and water 260 fed into the column 210.

In some embodiments, a method for extracting bitumen from bituminous material includes simultaneously loading bitumen material and solvent into a column. Such a method may mitigate or eliminate drainage problems relating to viscous bitumen-enriched solvent being unable to flow downwardly through initially dry bitumen material loaded in the column.

Figure 3:
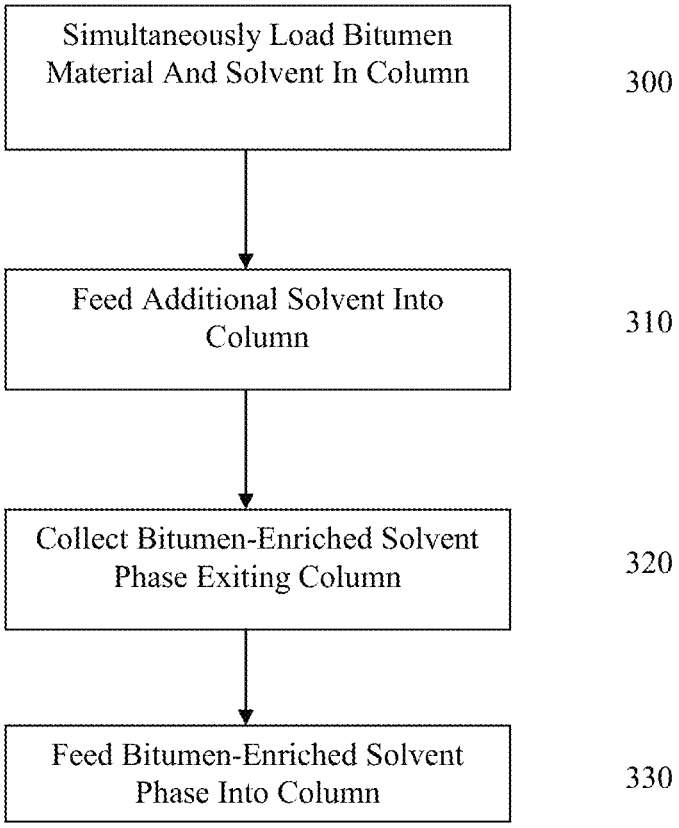
FIG. 3 is a flow chart detailing a method for obtaining bitumen from bituminous material as disclosed herein.

With reference to FIG. 3, the method includes a step 300 of simultaneously loading bitumen material and solvent in a column, a step 310 of feeding additional solvent into the column, a step 320 of collecting bitumen-enriched solvent exiting the column, and an optional step 330 of feeding the bitumen-enriched solvent into the column.

With respect to step 300, the bitumen material and the solvent can be identical to the bitumen material and the solvent described in greater detail above, including the use of solvent having some bitumen content. Similarly, the column into which the bitumen material and the solvent are simultaneously loaded can be identical to the column described in greater detail above.

The manner in which the bitumen material and the solvent are loaded into the column can be similar or identical to the loading and feeding described above in greater detail. In some embodiments, the bitumen material is loaded into the column from a top end of the column while the solvent is injected into the column from the side of the column at several positions along the height of the column. In this manner, bitumen material dropping into the column is intersected by solvent entering the column from several side injection ports located along the height of the column.

The simultaneous introduction of the bitumen material and the solvent into the column can include any loading procedure where at least a portion of the solvent and a portion of the bitumen material are loaded into the column at the same time. In some embodiments, the solvent and the bitumen material are only loaded into the column at the same time. However, in other embodiments, the addition of bitumen material and solvent need not be simultaneous throughout the entire loading process. A portion of the solvent can be fed into the column prior to also adding bitumen material into the column, and a portion of the bitumen material can be fed into the column prior to also adding the solvent into the column. Furthermore, additional solvent can be fed into the column after the addition of bitumen material has ceased, and additional bitumen material can be fed into the column after the addition of solvent has ceased.

Generally speaking, the amount of solvent fed into the column as part of step 300 is based on the S:B ratio described in greater detail above. In some embodiments, the S:B ratio for this embodiment ranges from about 0.75 to about 4.0, and more preferably from about 1.5 to about 2.5. Like the previously described method, S:B ratios in this range ensure that viscosity of the bitumen components of the bitumen material are sufficiently decreased to provide for the flow of the bitumen in the solvent out of the column.

As described above in greater detail, the method may include steps to ensure a packed column with minimal void spaces. Such steps can include a reduction in the size of the pieces of the bitumen material prior to loading the bitumen material in the column.

The simultaneous addition of solvent and bitumen material into the column results in the solvent dissolving bitumen contained in the bitumen material and creating bitumen-enriched solvent. The addition of the solvent to the bitumen may reduce the viscosity of the bitumen and make it flowable as part of the bitumen-enriched solvent. Accordingly, bitumen-enriched solvent created by the simultaneous addition of the solvent and the bitumen material can flow out of the column as part of step 300. This bitumen-enriched solvent can be collected and set aside as a final product rather than recycling this bitumen-enriched solvent back into the column.

After step 300, the method of extracting bitumen may proceed in a similar fashion to the method described above in greater detail. Step 310 of feeding an additional amount of solvent into the column may proceed in a similar fashion to step 110 described above in greater detail. The additional solvent can be the same solvent as used in step 310 or another solvent capable of dissolving bitumen. The additional solvent can be fed into the column in any suitable manner, such as by injecting the solvent into the column from the side of the column at multiple locations along the height of the column. The amount of additional solvent fed into the column can be at a S:B ratio in the range of from about 0.75 to about 4.0.

As with the addition of solvent in step 110, the additional solvent fed into the column in step 310 flows downwardly through the column. The additional solvent dissolves bitumen contained in the bitumen material (and not already dissolved during step 300) and displaces any bitumen-enriched solvent that did not flow out of the column during or after step 300. The addition of additional solvent in step 310 can result in bitumen-enriched solvent exiting the column at the bottom end of the column. In some embodiments, the bitumen-enriched solvent exiting the column as part of step 310 has a bitumen content lower than the bitumen content of the bitumen-enriched solvent exiting the column during or after step 300. This may be due to there being a relatively minor amount of bitumen-enriched solvent still remaining in the column after step 300 and the relatively high amount of first solvent added into the column as part of step 310.

Additionally, as described in greater detail above, external forces can be used to promote the downward flow of the additional solvent through the column or promote the liberation and displacement of dissolved bitumen. For example, as described in greater detail above, a pressurized gas can be added to the column before or after an amount of solvent has been added to the column to help promote bitumen extraction.

In step 320, the bitumen-enriched solvent that exits the column during the method is collected. Step 320 may be similar or identical to step 130 described in greater detail above. Any suitable method for collecting the bitumen-enriched solvent can be used, and collection can be carried out for any suitable period of time.

In step 330, bitumen-enriched solvent collected in step 320 is fed back into the column to further extract bitumen remaining in the column. Step 330 may be similar or identical to step 130 described in greater detail above. The bitumen-enriched solvent fed back into the column flows downwardly through the column to dissolve bitumen not dissolved in step 310 or displace bitumen-enriched solvent entrapped in the material loaded in the column. The bitumen-enriched solvent exiting the column as a result of feeding previously collected bitumen-enriched solvent back into the column is collected and either recycled back into the column to promote further bitumen extraction or subjected to separation and upgrading. Repeated reintroduction of bitumen-enriched solvent into the column to achieve further bitumen extraction may result in removal of about 90%, more preferably about 95%, and most preferably about 99% of the bitumen contained in the bitumen material. In some embodiments, the solvent may be light enough to precipitate asphaltenes as a means to reject the heavy portion of the bitumen within the bitumen material. In such embodiments the total bitumen dissolved will be lower by virtue of the asphaltene component rejection.

As discussed in greater detail above, some solvent remains in the column after collection of bitumen-enriched solvent has been completed. In order to remove this solvent from the now bitumen-depleted bitumen material loaded in the column, water can be fed into the column to displace first solvent out of the column. The water can also be added to the column in a two stages as described in greater detail above. The mixture of solvent and water exiting the column as a result of feeding water into the column is collected and separated into solvent and water. In this manner, the solvent and water can be reused in the process. The separation of the mixture of solvent and water may be similar or identical to the separation processes described in greater detail above.

Figure 4:
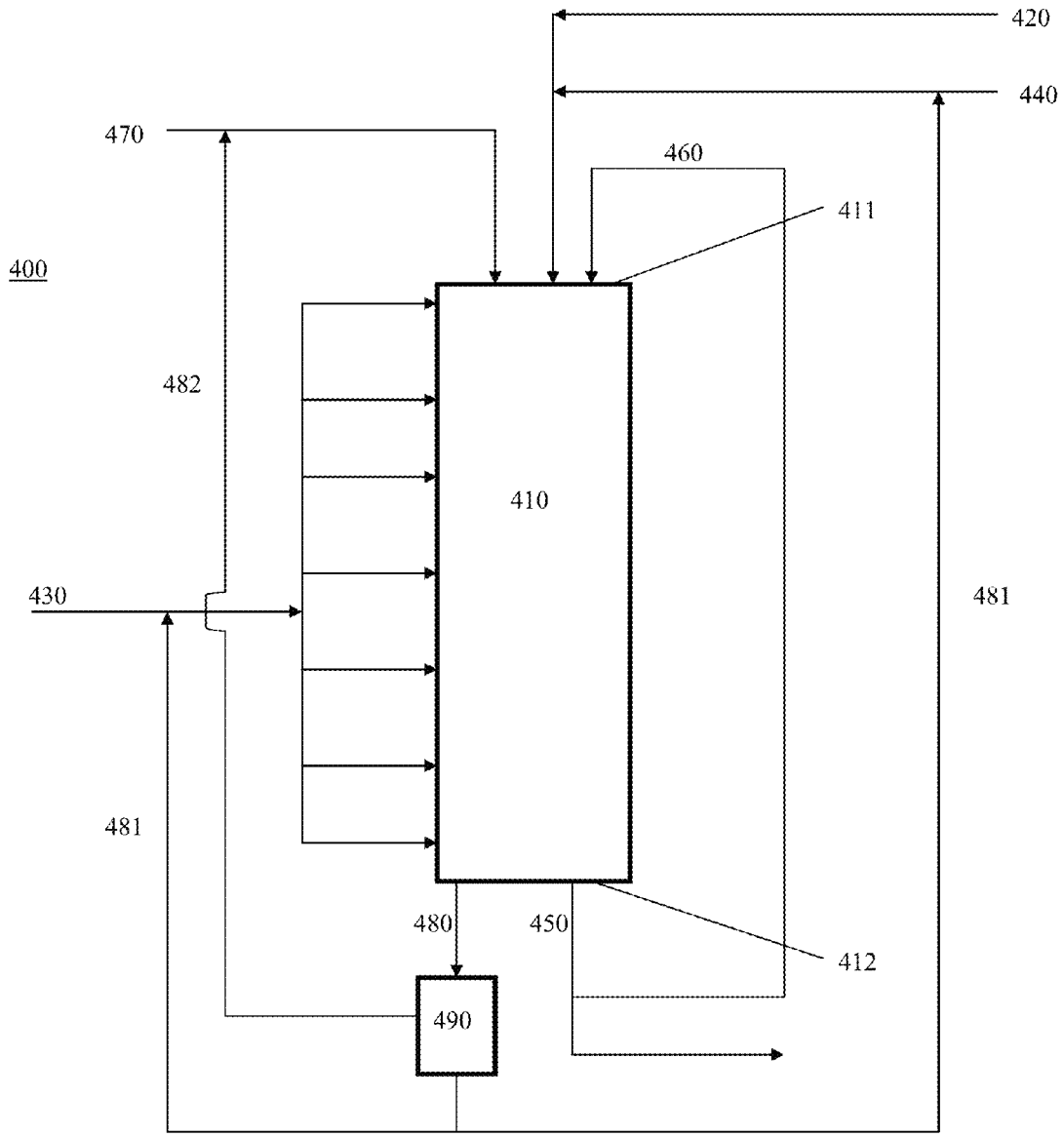
FIG. 4 is a schematic diagram for a system and method for obtaining bitumen from bituminous material as disclosed herein.

With reference to FIG. 4, a system 400 for carrying out the method described above is illustrated. The system includes a column 410 in which bitumen extraction may take place. The column 410 may be vertically oriented and have a top end 411 and a bottom end 412 opposite the top end 411 and be free of any obstructions in the interior region of the column 410. Bitumen material 420 and a first quantity of solvent 430 are simultaneously fed into column 410. In so doing, the bitumen material 420 and the solvent 430 mix together to form a mixture of bitumen material and solvent that occupies the column 410.

After the solvent 430 and the bitumen material 420 have been loaded in the column 410, an additional quantity of solvent 440 is fed into the column 410. The additional solvent 440 flows downwardly through the column 410 to dissolve any bitumen in the column 410 not dissolved during the initial loading of the bitumen material 420 and the first quantity of solvent 430 and to displace any bitumen-enriched solvent created during the initial loading of the bitumen material 420 and the quantity of first solvent 430 but which has not flowed out of the column 410 during the simultaneous addition of the solvent 430 and the bitumen material 420. Ultimately, a bitumen-enriched solvent 450 exits the column 410 at the bottom end 412 of the column 410, where it is collected. The collected bitumen-enriched solvent 450 is fed back into the column 410 as a recycle stream 460 in order to extract any undissolved bitumen or displace any entrapped bitumen-enriched solvent. The collection and recycling of bitumen-enriched solvent 450 back into the column 410 can be performed one or more times. Once a sufficient number of recycling cycles has taken place, the bitumen-enriched solvent 450 is collected and separated into bitumen and solvent. The solvent may be reused in the method, such as a make-up stream to the solvent 430 fed into the column 410, and the bitumen may be subjected to further processing to upgrade the bitumen into commercially useful product.

A portion of the solvent 430/440 remains in the now bitumen-depleted bitumen material 420 loaded in the column 410. The solvent 430/440 remaining in the column 410 is removed from the column 410 by feeding water 470 into the top end 411 of the column 410. The water 470 displaces solvent 430/440 out of the column 410 as it flows downwardly through the column 410. Initially, the material displaced out of the column 410 may be only solvent 430/440. Eventually, a solvent-water mixture 480 exits at the bottom end 412 of the column 410, where it is collected and transported to a separation unit 490. The separation unit 490 separates the solvent-water mixture 480 into solvent 481 and water 482, and both the solvent 481 and the water 482 can be reused in the method, such as make-up streams for the first quantity of solvent 430 or the additional solvent 440 and the water 470 fed into the column 410.

Several advantages can be realized by using the methods and systems described herein. Specifically, the use of a single solvent where the solvent is paraffinic can provide numerous advantages over other solvent bitumen extraction techniques, including those techniques using more than one type of solvent. Firstly, the use of paraffinic solvent can increase the throughput of the method by a factor of 2 or greater. Improved throughput can be realized due to the use of the lighter paraffinic solvent that is capable of solvating the bitumen material faster than heavier solvents and results in reduced viscosity dilbit, which can be recovered from the solids easier. The paraffinic solvent can also advantageously precipitate asphaltenes, further eliminating the heavy viscosity component. In some instances, the paraffinic solvent causes the asphaltenes to precipitate into the solids, and more specifically onto the finer clays. The precipitated asphaltenes are captured by finer clays while the dilbit passes through and out of the bitumen material for successful bitumen extraction. The precipitation of asphaltene can also be beneficial by allowing for the upgrading of bitumen extracted in the dilbit using conventional upgrading processing equipment (i.e., specialized upgrading equipment capable of handling asphaltenes as well as bitumen is not required).

The systems and methods that use a single solvent instead of two different types of solvents can also be advantageous from a capital expenditure (CAPEX) perspective. Single solvent systems typically only require a single distillation unit for the separation and recovery of the single solvent. Single solvent systems, including single solvent systems using a paraffinic solvent, also tend to require smaller distillation units as compared to when heavier solvents are used. Operating expenditures (OPEX) are also reduced when using a single solvent system versus a two solvent system. For example, lower heating duty is required for removing a single, relatively light, solvent from the tailings. Finally, environmental advantages can result from the single solvent system. Carbon dioxide emissions and fugitive solvent loses can be reduced when a single solvent system is used in lieu of a system that uses two different types of solvents.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

What is claimed is:

1. A method comprising:

loading bitumen material in a column;

feeding a first quantity of water into the column;

feeding a first quantity of solvent into the column; and collecting bitumen-enriched solvent exiting the column;

wherein feeding of the first quantity of water into the column is done after collecting bitumen-enriched solvent exiting the column.

2. The method as recited in claim 1, further comprising: feeding a quantity of the bitumen-enriched solvent into the column.

3. The method as recited in claim 1, wherein the bitumen material is oil sands.

4. The method as recited in claim 1, wherein the column is a vertically-oriented column comprising a top end and a bottom end opposite the top end, and being free of obstructions within the column.

5. The method as recited in claim 4, wherein loading bitumen material in a column comprises loading bitumen material into the top end of the vertically oriented column.

6. The method as recited in claim 1, wherein feeding a first quantity of solvent into the column comprises feeding the first quantity of solvent into the column at two or more locations spaced along a length of the column.

7. The method as recited in claim 1, wherein feeding a first quantity of solvent into the column comprises feeding a first portion of the first quantity of the solvent into the column followed by feeding a remaining portion of the first quantity of the solvent into the column.

8. The method as recited in claim 1, wherein the first solvent comprises a paraffinic solvent.

9. The method as recited in claim 8, wherein the paraffinic solvent comprises pentane.

10. The method as recited in claim 1, wherein the first quantity of solvent is one or more times a bitumen quantity of the bitumen material loaded in the column on v/v basis.

11. The method as recited in claim 2, wherein the steps of collecting bitumen-enriched solvent exiting the column and feeding a quantity of the bitumen-enriched solvent into the column are repeated one or more times.

12. The method as recited in claim 1, wherein feeding a first quantity of water into the column comprises feeding a first portion of the first quantity of the water into the column as a liquid followed by feeding a remaining portion of the first quantity of the water into the column as steam.

13. The method as recited in claim 1, further comprising: packing down the bitumen material loaded in the column prior to feeding a first quantity of solvent into the column.

14. The method as recited in claim 1, further comprising: reducing in size individual pieces of the bitumen material prior to loading the bitumen material in the column.

* * * * *